US006271799B1

(12) United States Patent
Rief et al.

(10) Patent No.: US 6,271,799 B1
(45) Date of Patent: Aug. 7, 2001

(54) ANTENNA HORN AND ASSOCIATED METHODS

(75) Inventors: Gary A. Rief, Melbourne; Douglas E. Heckaman, Indialantic; Robert J. Schrimpf, Melbourne, all of FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/504,369

(22) Filed: Feb. 15, 2000

(51) Int. Cl.[7] ..... H01Q 13/00
(52) U.S. Cl. ..... 343/776; 343/786
(58) Field of Search ..... 343/700 MS, 797, 343/776, 786; H01Q 13/09

(56) References Cited

U.S. PATENT DOCUMENTS

| | | | | |
|---|---|---|---|---|
| 3,714,652 | * | 1/1973 | Grabowski et al. | 343/786 |
| 4,157,550 | | 6/1979 | Reid et al. | 343/786 |
| 4,278,955 | | 7/1981 | Lunden | 333/33 |
| 4,370,659 | | 1/1983 | Chu et al. | 343/772 |
| 4,571,593 | | 2/1986 | Martinson | 343/783 |
| 4,644,362 | * | 2/1987 | Rammos | 343/778 |
| 4,684,952 | | 8/1987 | Munson et al. | 343/700 MS |
| 4,811,028 | * | 3/1989 | Bryanos | 343/786 |
| 4,829,314 | * | 5/1989 | Barbier et al. | 343/778 |
| 4,878,061 | | 10/1989 | Nusair et al. | 343/786 |
| 4,931,808 | | 6/1990 | Lalezari et al. | 343/753 |
| 4,973,925 | | 11/1990 | Nusair et al. | 333/26 |
| 5,276,455 | | 1/1994 | Fitzsimmons et al. | 343/777 |
| 5,359,339 | | 10/1994 | Agrawal et al. | 343/786 |
| 5,363,105 | | 11/1994 | Ono et al. | 342/20 |
| 5,471,223 | | 11/1995 | McCorkle | 343/786 |
| 5,471,664 | * | 11/1995 | Kim | 343/700 MS |
| 5,488,380 | | 1/1996 | Harvey et al. | 342/368 |
| 5,517,203 | * | 5/1996 | Fiedziuszko | 343/776 |
| 5,523,728 | | 6/1996 | McCorkle | 333/128 |
| 5,737,698 | * | 4/1998 | Gabrelian et al. | 343/786 |
| 5,754,144 | | 5/1998 | McEwan | 343/786 |
| 5,779,844 | | 6/1998 | Lewis et al. | 156/275.5 |
| 5,805,110 | | 9/1998 | McEwan | 342/387 |
| 6,111,547 | * | 8/2000 | Gau et al. | 343/786 |

* cited by examiner

*Primary Examiner*—Hoanganh Le
(74) *Attorney, Agent, or Firm*—Allen, Dyer, Doppelt, Milbrath & Gilchrist, P.A.

(57) ABSTRACT

An antenna device includes a dual polarized quad-ridge antenna horn having an electrically conductive conduit with first and second opposite ends along a horn axis. Four electrically conductive ridges are carried on an inner side of the electrically conductive conduit. A printed wiring board including a dielectric substrate is connected across the first end of the dual polarized quad-ridge antenna horn and transversely to the horn axis. Furthermore, an electrically conductive pattern is formed on the dielectric substrate and defines feed elements for the dual polarized quad-ridge antenna horn.

23 Claims, 8 Drawing Sheets

ANTENNA HORN AND ASSOCIATED METHODS

FIELD OF THE INVENTION

The present invention relates to the field of Radio Frequency (RF) communications, and, more particularly, to microwave antennas.

BACKGROUND OF THE INVENTION

The ridge horn antenna is a type of broadband antenna that is often used in communications systems. A ridge horn antenna generally includes ridges which carry electromagnetic energy from the signal source to the illumination area of the ridge horn antenna. An impedance transformer may be inserted between the ridges to match the input impedance of the antenna to the source. The antenna gain of the ridge horn antenna is typically higher than that of spiral and sinuous types of planar antennas, but generally less than most directional narrow beam antennas.

A reflector is often used to achieve a required level of gain for a highly directional antenna. A reflector antenna generally includes a reflector dish and a feed horn in one of many configurations. Two well known configurations of a feed horn antenna are the rectangular horn and cylindrical horn. In such configurations, the feed horn is a radiator mounted at the focal point of a reflector. Electromagnetic energy radiates from the feed horn to the metallic surface of the reflector dish from which it is reflected in a desired direction.

More specifically, a quad-ridge horn is an example of a ridge horn antenna and has a hollow conductive conduit usually having a circular cross section for propagation of microwaves between two points. The horn conduit may be formed of an electrically conductive material or of a non-conductive material that is plated or coated with an electrically conductive material. Moreover, to receive signals, horn antennas are dimensioned and flared to receive a concentration of low energy but discernable fields at one or more specific frequencies in the throat area of the horn.

A quad-ridge horn is dual-polarized and includes four ridges or tapered blades which aid in the propagation of the microwaves. Detectors are inserted or placed at the throat of the horn to receive the energy from the fields at the frequency or frequencies for which the horn has been designed. The horn is typically coupled to circuitry through orthogonal coaxial probes for input/output of Radio Frequency (RF) signals. Thus, external cables and connectors are necessary for transition to a planar distribution network.

Making an array of horns can be difficult because of the size requirements due to the RF input/output cabling, e.g. in higher frequency applications. Furthermore, soldering and micro-assembly during manufacture of the horn is difficult to automate resulting in higher costs and variable RF characteristics.

Additionally, some conventional dual-ridge horns with single polarization use microstrip feed lines or launches for transitions to circuitry. For example, U.S. Pat. No. 4,973,925 to Nusair et al., entitled "Double-Ridge Waveguide to Microstrip Coupling" discloses the use of modified ridges of a section of a double-ridge waveguide to match a microstrip circuit. Also, U.S. Pat. No. 4,157,550 to Reid et al., entitled "Microwave Detecting Device With Microstrip Feed Line" discloses the use of a slot in a waveguide to accommodate a microstrip feed line. However, in both patents, the microstrip circuit is positioned in the plane of the waveguide axis and the approaches are limited to single polarized dual-ridge waveguides/horns.

Additionally, U.S. Pat. No. 5,359,339 to Agrawal et al., entitled "Broadband Short-horn Antenna" discloses a horn array having a short-circuiting wall carrying a plurality of feed probes for the horns. Although the short-circuiting wall is mounted at the rear of the horn array, feed probes are used which may make it difficult to automate soldering and micro-assembly during manufacture of the horn array, resulting in higher costs and variable RF characteristics.

SUMMARY OF THE INVENTION

In view of the foregoing background, it is therefore an object of the invention to ease the manufacture and decrease the size requirements for a quad-ridge horn with dual polarization and/or for an array of quad-ridge horns.

This and other objects, features and advantages in accordance with the present invention are provided by an antenna device which includes a dual polarized quad-ridge antenna horn having an electrically conductive conduit with first and second opposite ends along a horn axis. Four electrically conductive ridges extend longitudinally on an inner side of the conductive conduit. A dielectric substrate is connected across the first end of the dual polarized quad-ridge antenna horn and transversely to the horn axis. Furthermore, an electrically conductive pattern is formed on the dielectric substrate and defines feed elements for the dual polarized quad-ridge antenna horn.

The feed elements for each antenna horn are preferably positioned orthogonal to each other on the dielectric substrate, and the electrically conductive pattern may further comprises portions corresponding to the electrically conductive conduit and the four electrically conductive ridges. Thus, the electrically conductive conduit and the four electrically conductive ridges are preferably connected to the corresponding portions of the electrically conductive pattern with an electrically conductive adhesive. Also, the dielectric substrate includes first and second opposite sides, and the electrically conductive pattern includes a first side conductive pattern on the first side of the dielectric substrate, and a second side conductive pattern on the second side of the dielectric substrate. The dual polarized quad-ridge antenna horn is secured to the first side of the dielectric substrate and electrically connected to the first side conductive pattern. Here, the electrically conductive pattern on the first and second sides may be connected together via conductors through in the dielectric substrate. Additionally, active circuits for the antenna device may be provided on the dielectric substrate and connected to the electrically conductive pattern.

Moreover, a phased array antenna may be formed from a plurality of antenna horns with the dielectric substrate connected across the first ends of the plurality of antenna horns and transversely to the horn axes. Here, the electrically conductive pattern on the dielectric substrate defines feed elements for each of the plurality of antenna horns. Because of the elimination of RF input/output cabling and the corresponding reduction in size, such a phased array antenna may be used in higher frequency applications. Furthermore, manufacture of the horn can be eased through automation resulting in lower costs and less variable RF characteristics.

Objects, features and advantages in accordance with the present invention are also provided by a method of making an antenna device including providing an antenna horn having first and second opposite ends along a horn axis; forming an electrically conductive pattern, defining at least one feed element for the antenna horn, on a dielectric substrate; and connecting the dielectric substrate across the first end of the antenna horn and transversely to the horn axis.

Also, a phased array antenna may be formed by providing a plurality of antenna horns, and forming the electrically conductive pattern to define feed elements for each of the plurality of antenna horns. The dielectric substrate is connected across the first ends of the plurality of antenna horns and transversely to the horn axes. Furthermore, each of the plurality of antenna horns may be a dual polarized quad-ridge horn each having an electrically conductive conduit and four electrically conductive ridges extending longitudinally on an inner side of the electrically conductive conduit. Here, the electrically conductive pattern preferably defines feed elements for each dual polarized quad-ridge horn, the feed element being preferably positioned orthogonal to each other on the dielectric substrate.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied as limited to the embodiments set forth herein. Rather, these embodiments are provided so that this disclosure will be thorough and complete, and will fully convey the scope of the invention to those skilled in the art. Like numbers refer to like elements throughout. The dimensions of layers and regions may be exaggerated in the figures for clarity.

Figure 1:
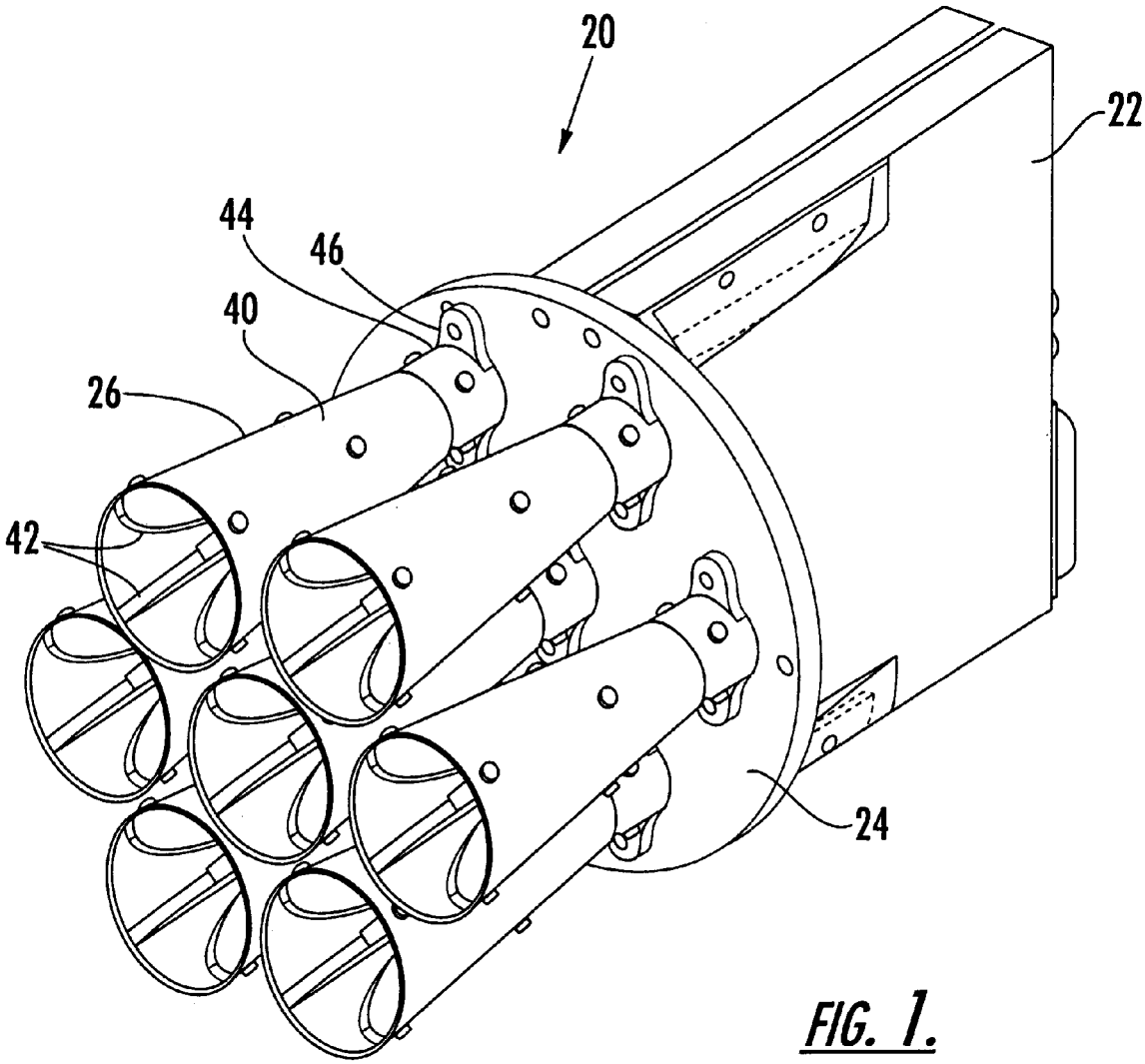
FIG. 1 is a perspective view of wideband phased array quad-ridge horn antenna in accordance with the present invention.
Figure 2:
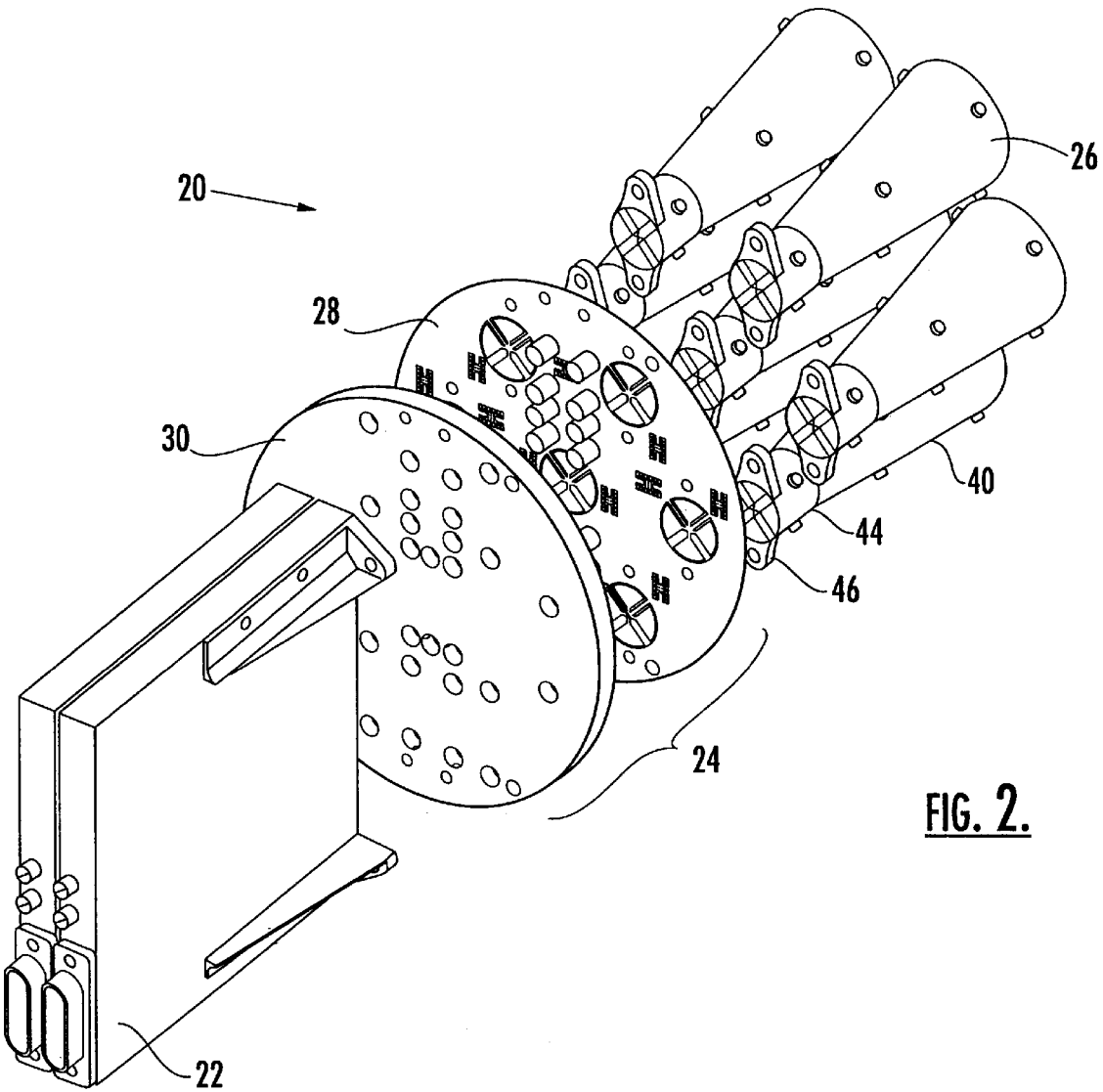
FIG. 2 is a exploded perspective view from the back of the phased array antenna of FIG. 1.
Figure 3:
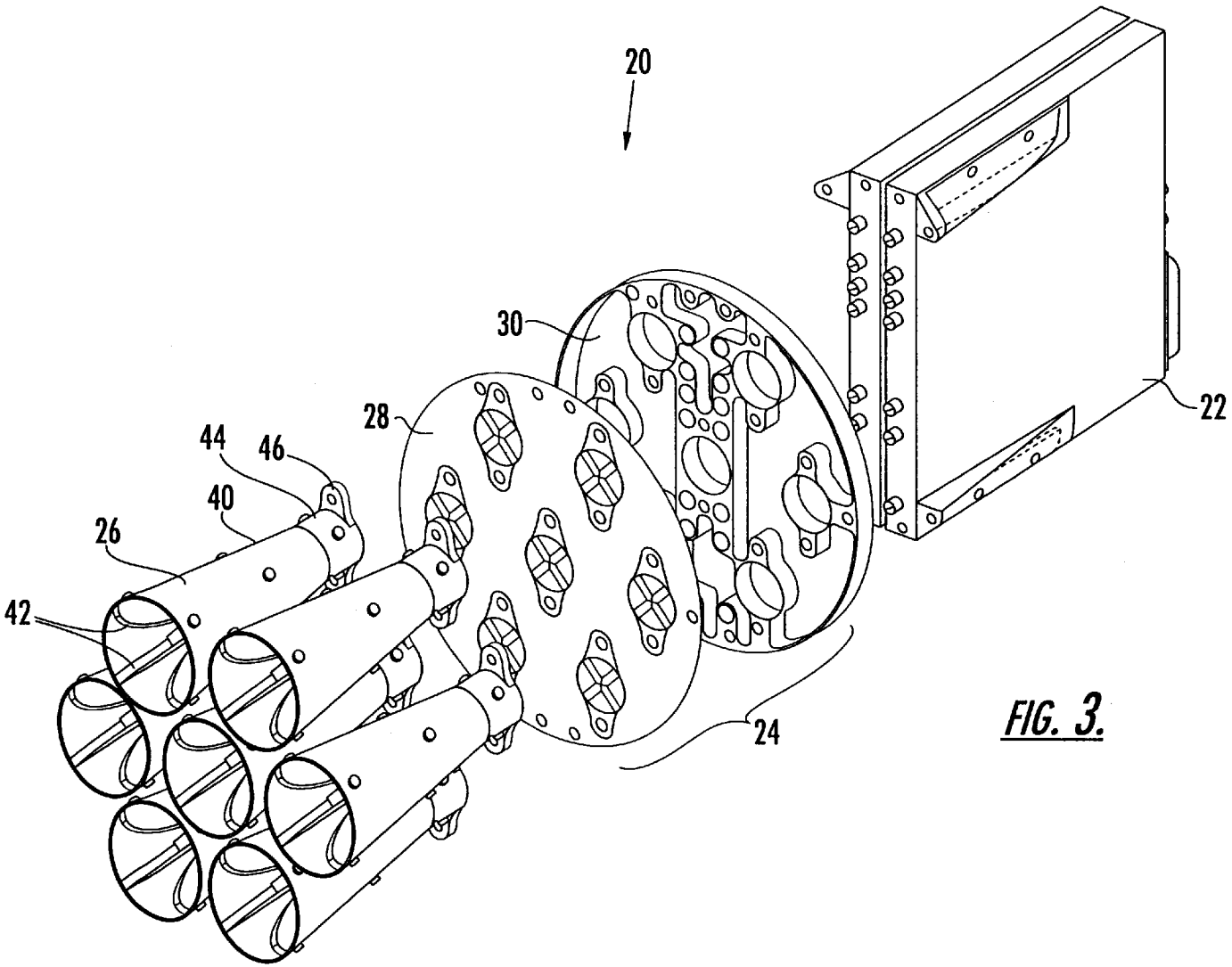
FIG. 3 is an exploded perspective view from the front of the phased array antenna of FIG. 1.

Referring to FIGS. 1–3, a wideband phased array quad-ridge horn antenna 20 in accordance with the present invention will now be described. A typical phased array antenna includes multiple stationary antenna elements in which the relative phases of the respective signals feeding the antenna elements are varied to scan an effective radiation pattern or beam in a desired direction. The phased array antenna 20 includes a control unit 22, launch assemble 24 and a plurality of quad-ridge horns 26. The launch assembly 24 includes a printed wiring board (PWB) 28 and a protector plate or PWB housing 30.

Figure 4:
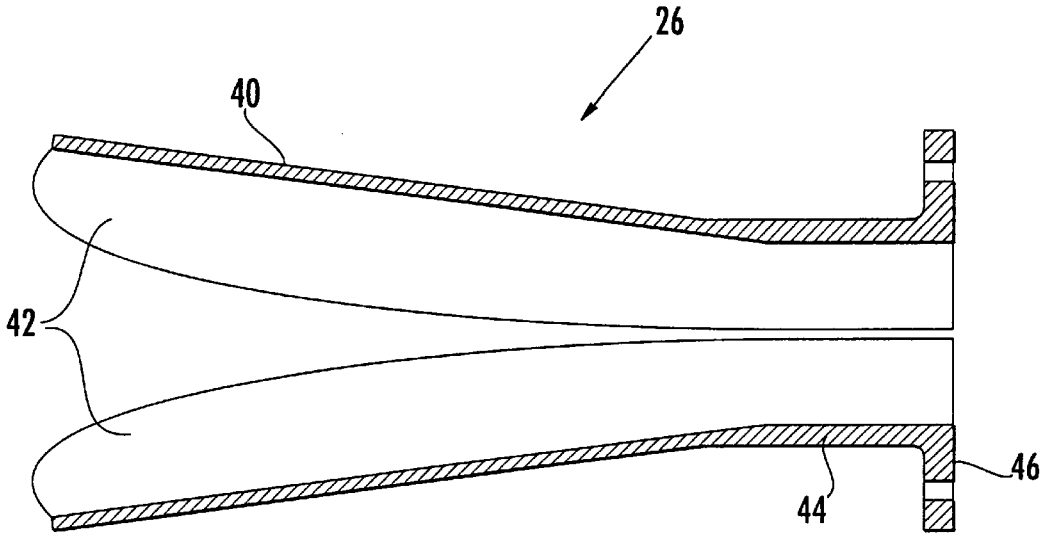
FIG. 4 is a longitudinal cross-sectional view of a quad-ridge horn in accordance with the present invention.
Figure 5:
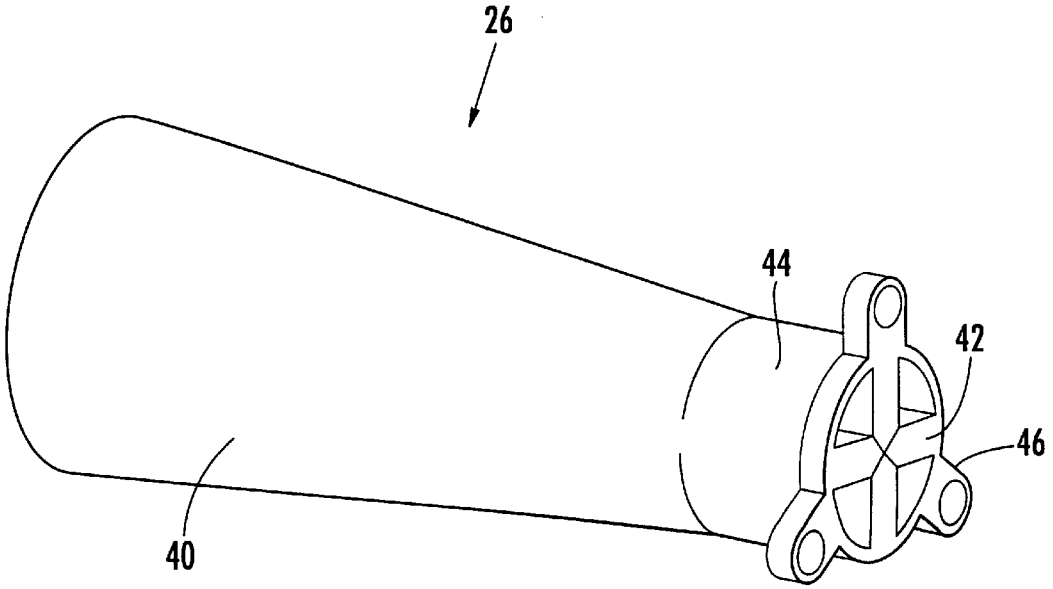
FIG. 5 is a perspective view of the quad-ridge horn of FIG. 4.
Figure 6:
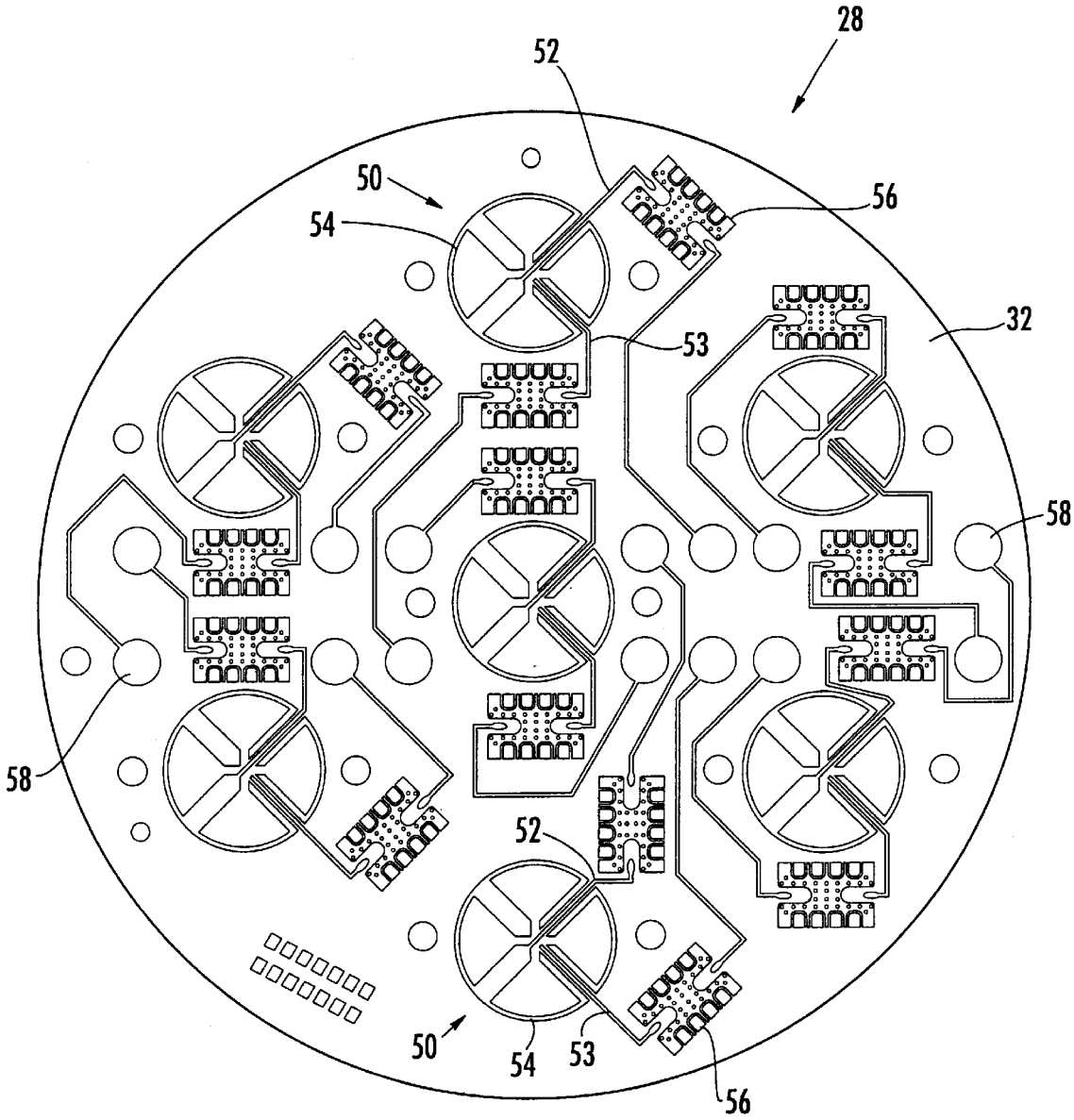
FIG. 6 is a bottom plan view of the substrate and conductive pattern for a phased array antenna as shown in FIG. 1.

Referring now to FIGS. 4 and 5, a quad-ridge horn 26 in accordance with the present invention will be described in further detail. The horn 26 includes a hollow electrically conductive conduit 40 having, for example, a circular cross section for propagation of microwaves between two points. The cross section increases in diameter from the first end to the second end. The horn conduit 40 may be formed of an electrically conductive material or of a non-conductive material that is plated or coated with an electrically conductive material as would be appreciated by the skilled artisan.

The conduit 40 is dimensioned and flared to receive and transmit a concentration of low energy but discernable fields at one or more specific frequencies in the throat area 44 of the horn 26 as would also be readily appreciated by those skilled in the art. This quad-ridge horn is dual-polarized and includes four electrically conductive tapered blades or ridges 42 which aid in the propagation of the microwaves. Here, these ridges 42 are equally spaced 90° apart and extend longitudinally to the opposite ends of the conduit 40 along the axis of the horn 26. As can be seen in FIG. 5, the ends of the ridges 42 in the throat are 44 are flush with the end of the conduit 40. Also, the throat area 44 of the conduit 40 includes mounting ears 46, e.g. for securing the horn 26 to the launch assembly 24.

Referring now to FIGS. 6–9, the PWB 28 will now be described in further detail. The PWB 28 includes a dielectric substrate 32 which is connected across first ends of the dual polarized quad-ridge antenna horn 26 and transversely to the horn axis. Furthermore, an electrically conductive pattern 50 is formed on the dielectric substrate 32 and defines feed elements 52, 53 for the dual polarized quad-ridge antenna horn 26. The conductive pattern 50 may be formed with any conductive material, for example copper, by any deposition technique including, for example electro-deposition as would be understood by those skilled in the art.

The two feed elements 52, 53 for each antenna horn 26 are preferably positioned orthogonal to each other on the dielectric substrate 28, and the conductive pattern 50 may further define portions 54 corresponding to the conductive conduit 40 and the four ridges 42. The length of the feed elements 52, 53 correspond to fractions of a wavelength as would be readily appreciated by the skilled artisan. The feed elements 52, 53 extend through portions of the conductive pattern 50 corresponding to two of the ridges 42 which are orthogonal to each other. The feed elements 52, 53 connect to portions of the conductive pattern 50 which correspond to ridges 42 which are respectively opposite to each of the other two ridges 42.

The PWB 28 may also include other active circuits or antenna electronics 56 such as, e.g., amplifiers or phase shifters, mounted on the dielectric substrate 32. The conductive pattern 50 may also include input/output tabs 58 for interfacing with connectors and/or the antenna control unit 22. The conductive conduit 40 and the four ridges 42 are preferably connected to corresponding portions of the conductive pattern 50 with an electrically conductive adhesive 64 on a side of the dielectric substrate 32 opposite to the side where the feed elements 52, 53 are disposed.

Figure 7:
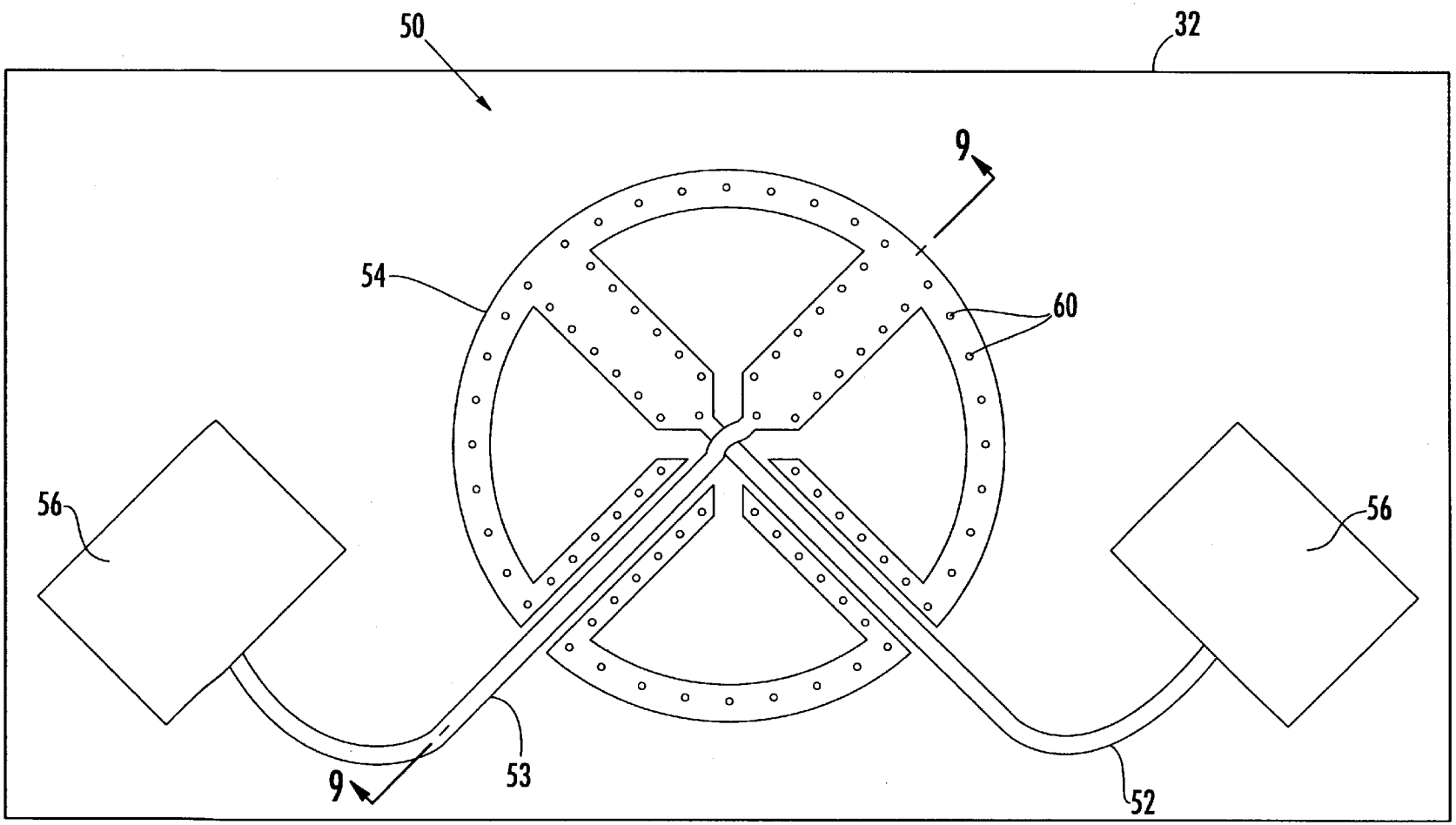
FIG. 7 is a bottom plan view of the substrate and conductive pattern for a single quad-ridge horn in accordance with the present invention.
Figure 8:
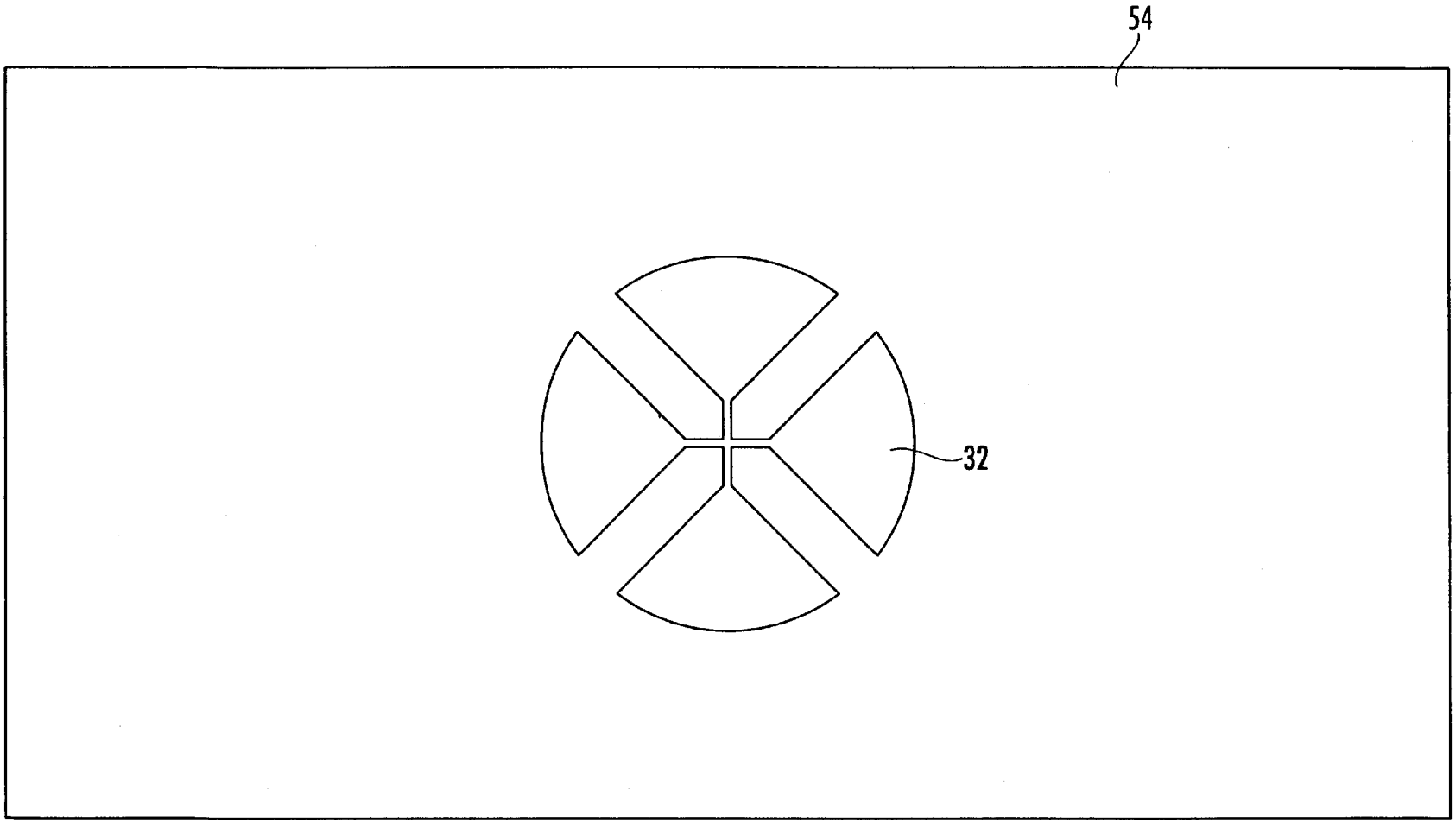
FIG. 8 is a top plan view of the substrate and conductive pattern the single quad-ridge horn in accordance with the present invention.

A dielectric substrate 32 for a single horn 26 will be described in reference to FIGS. 7 and 8. Again, the conductive pattern 50 includes portions 54 and feed elements 52, 53 which are connected to antenna electronics 56. The portions 54 include plated through holes 60 or conductors for connecting the conductive pattern 50 to the conductive pattern on the opposite side of the dielectric PWB 28. FIG. 7 illustrates the back side of the dielectric substrate 32 which is opposite to the side connected to the horn or horns 26 as can also be seen in FIGS. 2 and 6. FIG. 8 illustrated the front side of the dielectric substrate 32 which includes the conductive portion 54 substantially covering the surface thereof. The front side of the dielectric substrate 32 is connected to the horn or horns 26 as can also be seen in FIG. 3.

Figure 9:
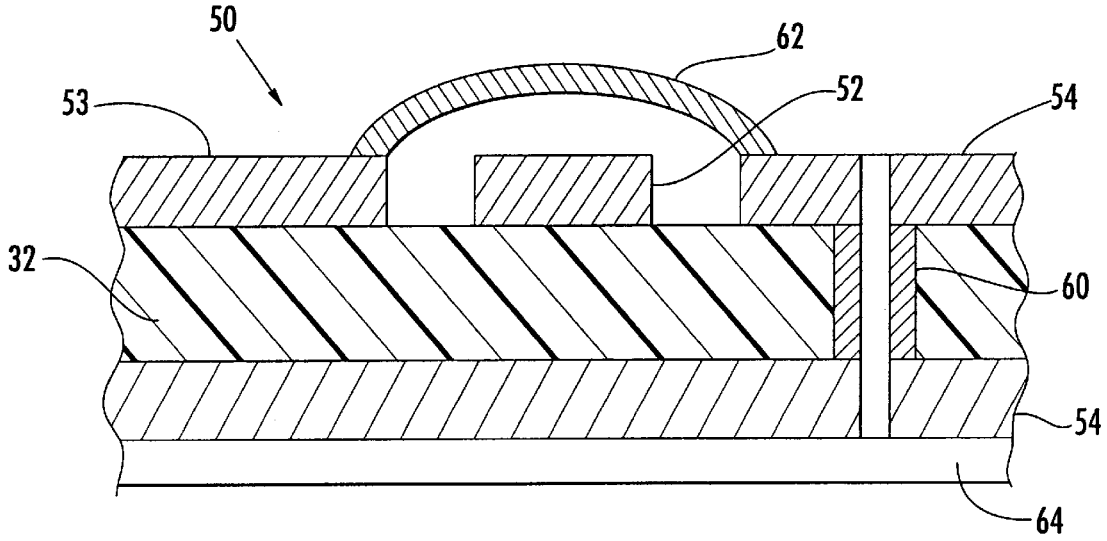
FIG. 9 is a cross-sectional view of the dielectric substrate taken along line 9—9 of FIG. 7.

Referring now to FIG. 9, a cross section of the dielectric substrate 32 and conductive pattern 50 taken along the line 9—9 in FIG. 7 will be described. Feed element 52 is connected to the portion 54 of the conductive pattern 50 in the same plane as the conductive pattern. Feed element 53 is orthogonal to feed element 52 and is connected to the portion 54 which corresponds to the ridge 42 which is opposite to the portion of the conductive pattern 50 corresponding to the ridge which the feed element 53 extends through.

Here, for example, the feed element 53 may be connected to the portion 54 through a jumper 62 soldered at both ends to the conductive pattern 50. Alternatively, this connection may be made with a conductive trace in another layer of the PWB 28. Plated through hole 60 is shown as connecting the conductive portion 54 on opposite sides of the dielectric substrate 32. Alternatively, these through holes 60 may be filled with a conductive material instead of just plated. The conductive conduit 40 and the four ridges 42 are connected to the conductive portions 54 with the conductive adhesive 64.

Thus, a phased array antenna 20 may be formed from a plurality of antenna horns 26 with the substantially planar dielectric substrate 28 connected across first ends of the plurality of antenna horns and transversely to the horn axes. Because of the elimination RF input/output cabling and the corresponding reduction in size, such a phased array antenna 20 may be used in higher frequency applications. Furthermore, manufacture of the antenna 20 and/or horns 26 can be eased through automation resulting in lower costs and less variable RF characteristics.

Another aspect of the invention includes a method of making an antenna device. The method includes providing an antenna horn 26 having first and second opposite ends along a horn axis, and forming the electrically conductive pattern 50, defining at least one feed element 52, 53 for the antenna horn, on a dielectric substrate 32. The method also includes connecting the dielectric substrate 32 across the first end of the antenna horn 26 and transversely to the horn axis.

Also, a method of making a phased array antenna 20 may include providing a plurality of antenna horns 26, and forming the electrically conductive pattern 50 to define feed elements 52, 53 for each of the plurality of antenna horns. The dielectric substrate 32 is connected across the first ends of the plurality of antenna horns 26 and transversely to the horn axes. Furthermore, each of the plurality of antenna horns 26 may be a dual polarized quad-ridge horn each having an electrically conductive conduit 40 and four electrically conductive ridges 42 extending longitudinally on an inner side of the conductive conduit. Here, the conductive pattern 50 preferably defines at least two feed elements 52, 53 for each dual polarized quad-ridge horn 26. The at least two feed elements 52, 53 are preferably positioned orthogonal to each other on the dielectric substrate 32.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna device comprising:

a dual polarized quad-ridge antenna horn comprising an electrically conductive conduit having first and second opposite ends along a horn axis, and four spaced apart electrically conductive ridges extending longitudinally on an inner side of the electrically conductive conduit;

a dielectric substrate connected across the first end of the dual polarized quad-ridge antenna horn and transversely to the horn axis; and an electrically conductive pattern on the dielectric substrate and defining feed elements for the dual polarized quad-ridge antenna horn, the electrically conductive pattern further comprising portions corresponding to the electrically conductive conduit and the four electrically conductive ridges.

2. An antenna device according to claim 1 wherein the feed elements are positioned orthogonal to each other on the dielectric substrate.

3. An antenna device according to claim 1 further comprising a conductive adhesive securing the electrically conductive conduit and the four ridges to the corresponding portions of the electrically conductive pattern.

4. An antenna device according to claim 1 wherein the dielectric substrate includes first and second opposite sides; wherein the electrically conductive pattern includes a first side conductive pattern on the first side of the dielectric substrate, and a second side conductive pattern on the second side of the dielectric substrate; and wherein the dual polarized quad-ridge antenna horn is secured to the first side of the dielectric substrate and electrically connected to the first side conductive pattern.

5. An antenna device according to claim 4 further comprising conductors through the dielectric substrate electrically connecting the first side conductive pattern on the first side of the dielectric substrate with the second side conductive pattern on the second side of the dielectric substrate.

6. An antenna device according to claim 1 further comprising active circuits on the dielectric substrate and connected to the electrically conductive pattern.

7. A phased array antenna comprising:

a plurality of dual polarized quad-ridge antenna horns each having first and second opposite ends along a horn axis, each of the plurality of antenna horns comprising an electrically conductive conduit and four spaced apart electrically conductive ridges extending longitudinally on an inner side of the electrically conductive conduit;

a dielectric substrate connected across the first ends of the plurality of antenna horns and transversely to the horn axes; and an electrically conductive pattern on the dielectric substrate and defining feed elements for each of the plurality of antenna horns, the electrically conductive pattern further comprising portions corresponding to the electrically conductive conduit and the electrically conductive ridges of each of the plurality of quad-ridge antenna horns.

8. A phased array antenna according to claim 7 wherein the electrically conductive pattern defines two feed elements for each dual polarized quad-ridge horn, the two feed elements being positioned orthogonal to each other on the dielectric substrate.

9. A phased array antenna according to claim 7 further comprising a conductive adhesive securing the electrically conductive conduit and the four electrically conductive ridges of each antenna horn to the corresponding portions of the electrically conductive pattern.

10. A phased array antenna according to claim 7 wherein the dielectric substrate includes first and second opposite sides; wherein the electrically conductive pattern includes a first side conductive pattern on the first side of the dielectric substrate, and a second side conductive pattern on the second side of the dielectric substrate; and wherein the plurality of antenna horns are secured to the first side of the dielectric substrate and electrically connected to the first side conductive pattern.

11. A phased array antenna according to claim 10 further comprising conductors through the dielectric substrate electrically connecting the first side conductive pattern on the first side of the dielectric substrate with the second side conductive pattern on the second side of the dielectric substrate.

12. A phased array antenna according to claim 7 further comprising active circuits on the dielectric substrate and connected to the electrically conductive pattern.

13. A method of making an antenna device comprising the steps of:

providing a dual polarized quad-ridge antenna horn having first and second opposite ends along a horn axis, the quad-ridge antenna horn comprising an electrically conductive conduit and four spaced apart electrically conductive ridges extending longitudinally on an inner side of the electrically conductive conduit;

forming an electrically conductive pattern, defining at least one feed element for the antenna horn, on a dielectric substrate, the electrically conductive pattern further comprises a portion corresponding to the electrically conductive conduit and the electrically conductive ridges; and connecting the dielectric substrate across the first end of the antenna horn and transversely to the horn axis.

14. A method according to claim 13 wherein the step of connecting the dielectric substrate across the first end of the antenna horn further comprises connecting the antenna horn to the corresponding portion of the electrically conductive pattern with an electrically conductive adhesive.

15. A method according to claim 13 wherein the dielectric substrate includes first and second opposite sides; wherein the electrically conductive pattern includes a first side conductive pattern on the first side of the dielectric substrate, and a second side conductive pattern on the second side of the dielectric substrate; and wherein the antenna horn is secured to the first side of the dielectric substrate and electrically connected to the first side conductive pattern.

16. A method according to claim 15 further comprising the step of electrically connecting the first side conductive pattern on the first side of the dielectric substrate and the second side conductive pattern on the second side of the dielectric substrate with conductors through the dielectric substrate.

17. A method according to claim 13 further comprising the step of providing active circuits on the dielectric substrate and connected to the electrically conductive pattern.

18. A method of making a phased array antenna comprising the steps of:

providing a plurality of dual polarized quad-ridge antenna horns each having first and second opposite ends along a horn axis, each of the plurality of quad-ridge antenna horns comprising an electrically conductive conduit and four spaced apart electrically conductive ridges extending longitudinally on an inner side of the electrically conductive conduit;

forming an electrically conductive pattern, defining feed elements for each of the plurality of antenna horns, on a dielectric substrate, the electrically conductive pattern further comprising portions corresponding to the electrically conductive conduit and the electrically conductive ridges of each of the plurality of antenna horns; and connecting the dielectric substrate across the first ends of the plurality of antenna horns and transversely to the horn axes.

19. A method according to claim 18 wherein the electrically conductive pattern defines feed elements for each dual polarized quad-ridge horn, the feed elements for each dual polarized quad-ridge horn being positioned orthogonal to each other on the dielectric substrate.

20. A method according to claim 18 wherein the step of connecting the dielectric substrate across the first ends of the plurality of antenna horns comprises connecting the electrically conductive conduit and the four electrically conductive ridges of each antenna horn to the corresponding portions of the electrically conductive pattern with an electrically conductive adhesive.

21. A method according to claim 18 wherein the dielectric substrate includes first and second opposite sides; wherein the electrically conductive pattern includes a first side conductive pattern on the first side of the dielectric substrate, and a second side conductive pattern on the second side of the dielectric substrate; and wherein the plurality of antenna horns are secured to the first side of the dielectric substrate and electrically connected to the first side conductive pattern.

22. A method according to claim 21 further comprising the step of electrically connecting the first side conductive pattern on the first side of the dielectric substrate and the second side conductive pattern on the second side of the dielectric substrate with conductors through the dielectric substrate.

23. A method according to claim 18 further comprising the step of providing active circuits on the dielectric substrate and connected to the electrically conductive pattern.

* * * * *

UNITED STATES PATENT AND TRADEMARK OFFICE

CERTIFICATE OF CORRECTION

PATENT NO. : 6,271,799 B1
APPLICATION NO. : 09/504369
DATED : August 7, 2001
INVENTOR(S) : Gary A. Rief, Douglas E. Heckaman and Robert J. Schrimpf It is certified that error appears in the above-identified patent and that said Letters Patent is hereby corrected as shown below:

| | |
|---|---|
| Column 2, Line 31 | Delete: "comprises"<br>Insert --comprise-- |
| Column 3, Line 40 | Delete: "pattern the single"<br>Insert --pattern of the single-- |
| Column 3, Line 64 | Delete: "assemble **24**"<br>Insert --assembly **24**-- |
| Column 4, Line 21 | Delete: "are **44**"<br>Insert --area **44**-- |
| Column 5, Line 33 | Delete: "elimination RF"<br>Insert --elimination of RF-- |

Signed and Sealed this

Fifth Day of September, 2006

JON W. DUDAS
*Director of the United States Patent and Trademark Office*